US010401080B2

(12) United States Patent
Root et al.

(10) Patent No.: US 10,401,080 B2
(45) Date of Patent: Sep. 3, 2019

(54) REFRIGERATOR APPLIANCE WITH A DISPENSER

(71) Applicant: Haier US Appliance Solutions, Inc., Wilmington, DE (US)

(72) Inventors: Steven Keith Root, Buckner, KY (US); Tyler James Doering, Louisville, KY (US); Joseph Thomas Waugh, Louisville, KY (US); Andrew Reinhard Krause, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 151 days.

(21) Appl. No.: 15/597,201

(22) Filed: May 17, 2017

(65) Prior Publication Data

US 2018/0335248 A1 Nov. 22, 2018

(51) Int. Cl.

| | |
|---|---|
| ***F25D 23/12*** | (2006.01) |
| ***F25D 29/00*** | (2006.01) |
| ***B67D 1/12*** | (2006.01) |
| ***F25C 5/20*** | (2018.01) |
| *B67D 1/08* | (2006.01) |

(52) U.S. Cl.

CPC ..... *F25D 23/126* (2013.01); *B67D 1/124* (2013.01); *B67D 1/1236* (2013.01); *B67D 1/1238* (2013.01); *F25C 5/22* (2018.01); *F25D 29/005* (2013.01); *B67D 1/0894* (2013.01); *F25C 2600/04* (2013.01); *F25C 2700/02* (2013.01); *F25D 2700/06* (2013.01)

(58) Field of Classification Search

CPC ..... F25D 23/12; F25D 23/126; F25D 29/005; F25D 2700/06; F25C 5/22; F25C 2600/04; F25C 2700/02; B67D 1/1238; B67D 1/1236; B67D 1/124; B67D 1/0894; B67D 1/1234; B67D 1/1202

See application file for complete search history.

(56) References Cited

U.S. PATENT DOCUMENTS

| | | | | |
|---|---|---|---|---|
| 5,491,333 | A | 2/1996 | Skell et al. | |
| 7,201,005 | B2 * | 4/2007 | Voglewede | F25D 23/126 222/146.6 |
| 7,673,661 | B2 * | 3/2010 | Chase | B67D 1/0858 141/360 |
| 8,109,301 | B1 * | 2/2012 | Denise | F25D 23/126 141/360 |
| 8,443,614 | B2 * | 5/2013 | Kim | F25D 29/00 141/370 |

(Continued)

*Primary Examiner* — Nicolas A Arnett

(74) *Attorney, Agent, or Firm* — Dority & Manning, P.A.

(57) ABSTRACT

A method for operating a refrigerator appliance includes operating a dispenser of the refrigerator appliance to initiate a flow of liquid water or ice into a container positioned within a dispensing recess of the dispenser in response to a user input at a user input panel of the refrigerator appliance, receiving one or more signals from a sensor positioned at the dispensing recess after operating the dispenser to initiate the flow of liquid water or ice into the dispensing recess, and detecting a presence of the container in the dispensing recess based at least in part on the one or more signals from the sensor only after operating the dispenser to initiate the flow of liquid water or ice into the dispensing recess. A related refrigerator appliance is also provided.

17 Claims, 4 Drawing Sheets

(56) References Cited

U.S. PATENT DOCUMENTS

| | | | | |
|---|---|---|---|---|
| 8,505,593 | B1 * | 8/2013 | Denise | F25D 23/126 141/95 |
| 8,695,646 | B2 | 4/2014 | Agam et al. | |
| 8,935,935 | B2 | 1/2015 | Waugh et al. | |
| 9,739,517 | B2 * | 8/2017 | Root | B67D 1/0888 |
| 10,101,080 | B2 * | 10/2018 | Willis | F25D 23/126 |
| 2008/0216504 | A1 * | 9/2008 | Kim | B67D 1/0005 62/338 |
| 2010/0155415 | A1 * | 6/2010 | Ashrafzadeh | B67D 1/001 222/1 |
| 2017/0010034 | A1 * | 1/2017 | Doering | F25D 23/126 |
| 2018/0045442 | A1 * | 2/2018 | Park | F25B 41/04 |

* cited by examiner

REFRIGERATOR APPLIANCE WITH A DISPENSER

FIELD OF THE INVENTION

The present disclosure relates generally to systems and methods for dispensing water or ice from an appliance.

BACKGROUND OF THE INVENTION

Refrigerator appliances generally include one or more cabinets defining chambers for the receipt of food items for storage. Refrigerator appliances may also include features for dispensing ice and/or liquid water. To provide ice and/or liquid water, a dispenser is typically positioned on a door of the appliance. The user positions a container proximate the dispenser, and ice and/or liquid water are deposited into the container depending upon the user's selection. A paddle or other type switch may be provided whereby the user may make a selection. Typically, the liquid water is chilled by routing the liquid water through one of the refrigerated chambers.

The water dispenser may have an associated sensor arrangement configured to detect the height and/or presence of a container positioned proximate the dispenser. However, known sensor arrangements suffer from several drawbacks. For example, detecting the height and/or presence of the container with the sensor can take several seconds, and this delay is inconvenient to a user. Thus, there is a need for a water dispensing system with improved automatic dispensing.

BRIEF DESCRIPTION OF THE INVENTION

The present subject matter provides a method for operating a refrigerator appliance that includes operating a dispenser of the refrigerator appliance to initiate a flow of liquid water or ice into a container positioned within a dispensing recess of the dispenser in response to a user input at a user input panel of the refrigerator appliance, receiving one or more signals from a sensor positioned at the dispensing recess after operating the dispenser to initiate the flow of liquid water or ice into the dispensing recess, and detecting a presence of the container in the dispensing recess based at least in part on the one or more signals from the sensor only after operating the dispenser to initiate the flow of liquid water or ice into the dispensing recess. A related refrigerator appliance is also provided. Aspects and advantages of the invention will be set forth in part in the following description, or may be obvious from the description, or may be learned through practice of the invention.

One example aspect of the present disclosure is directed to a refrigerator appliance with a cabinet that defines a chilled chamber. A door is mounted to the cabinet. The door is configured for permitting selective access to the chilled chamber of the cabinet. The refrigerator appliance also includes a user input panel and a dispenser that defines a dispensing recess. The dispenser includes a nozzle for dispensing liquid water or ice. The nozzle is positioned at the dispensing recess. A sensor is disposed at the dispensing recess, the sensor configured to receive one or more signals indicative of a presence of a container proximate the dispensing recess and a level of contents in the container. One or more control devices are in operative communication with the user input panel, the dispenser and the sensor. The one or more control devices are configured to operate the dispenser to initiate a flow of liquid water or ice into the dispensing recess through the nozzle in response to a user input at the user input panel, receive one or more signals from the sensor after operating the dispenser to initiate the flow of liquid water or ice into the dispensing recess, and detect the presence of the container within the dispensing recess based at least in part on the one or more signals from the sensor only after operating the dispenser to initiate the flow of liquid water or ice into the dispensing recess.

Another example aspect of the present disclosure is directed to a method for operating a refrigerator appliance. The method includes operating a dispenser of the refrigerator appliance to initiate a flow of liquid water or ice into a container positioned within a dispensing recess of the dispenser in response to a user input at a user input panel of the refrigerator appliance, receiving one or more signals from a sensor positioned at the dispensing recess after operating the dispenser to initiate the flow of liquid water or ice into the dispensing recess, and detecting a presence of the container in the dispensing recess based at least in part on the one or more signals from the sensor only after operating the dispenser to initiate the flow of liquid water or ice into the dispensing recess.

Yet another example aspect of the present disclosure is directed to a method for operating a refrigerator appliance. The method includes operating a dispenser of the refrigerator appliance to initiate a flow of liquid water or ice into a container positioned within a dispensing recess of the dispenser in response to detecting the container within the dispensing recess, receiving one or more signals from a sensor positioned at the dispensing recess after operating the dispenser to initiate the flow of liquid water or ice into the dispensing recess, and detecting a lip of the container in the dispensing recess based at least in part on the one or more signals from the sensor only after operating the dispenser to initiate the flow of liquid water or ice into the dispensing recess.

Variations and modifications may be made to these example embodiments of the present disclosure. These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
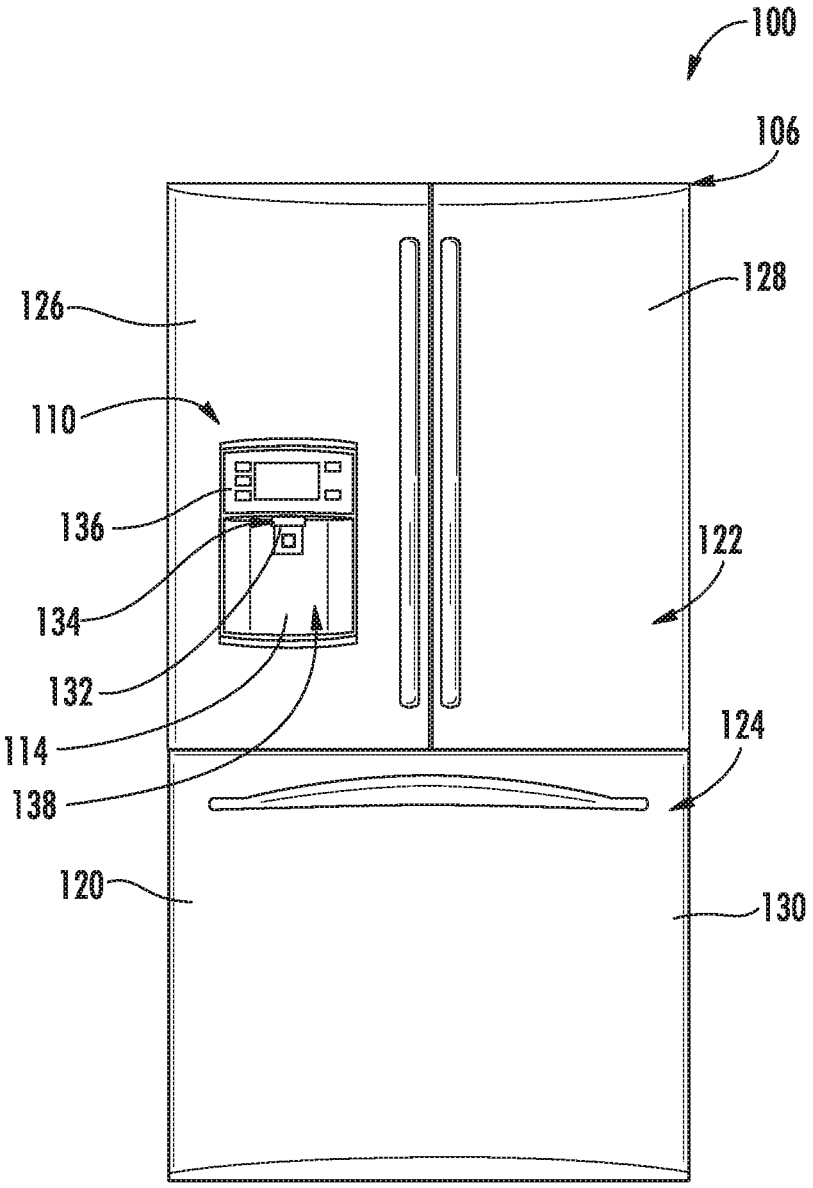
FIG. 1 provides a front, elevation view of a refrigerator appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment may be used with another embodiment to yield a still further embodiment. Thus, it is intended that the present invention covers such modifications and variations as come within the scope of the appended claims and their equivalents.

Example aspects of the present disclosure are directed to refrigerator appliances with features for dispensing liquid water or ice and related methods. More particularly, a sensor associated with a dispensing system may be configured to detect a presence of a container positioned proximate the dispensing system. The sensor may be further configured to determine a height of the container and/or a level of contents within the container. In example embodiments, the sensor may be an ultrasonic sensor positioned on an upper portion of the dispensing system, such that the sensor transmits signals parallel to the liquid water stream dispensed by the dispenser. To flow liquid water and/or ice into the container, a user provides an input at a user input panel. The liquid water or ice is dispensed in response to the input. While the liquid water or ice is flowing into the container, the sensor may detect the container, and subsequently send a signal indicative of the detected container to a control system associated with the dispenser. The control system may then enable the dispenser to terminate dispensing of liquid water or ice, for instance, when the container is suitably filled with liquid water or ice. It will be appreciated by those skilled in the art that the dispenser may be configured to dispense various other suitable forms of liquid instead of or in addition to liquid water without deviating from the scope of the present disclosure.

Once the container has been detected, a height of the container may be determined. In particular, the sensor may be further configured to detect a top lip of the container. The sensor may send a signal indicative of the lip to the control system, and the control system may determine a height of the container based at least in part on the signal.

As the container fills with liquid water or ice, a level of the liquid water or ice within the container may be determined. For instance, the sensor may detect the liquid water or ice, and may send a signal indicative of the liquid water or ice to the control system, which may determine the level of the liquid water or ice from the signal. When the difference between the height of the container and the level of the liquid water or ice falls below a threshold, the dispenser may cease dispensing liquid water or ice. In example embodiments, the threshold may be in the range of about a half inch (0.5") to about three inches (3"). As used herein, the term "about," when used in reference to a numerical value, is intended to refer to within twenty percent (20%) of the numerical value. It will be appreciated that various other suitable thresholds may be used. In example embodiments, the level of the liquid water or ice relative to the height of the lip of the container may be determined at least in part from the amount of time between detecting the top lip and detecting the liquid water or ice.

Referring now to the figures, FIG. 1 depicts a front view of an example embodiment of a refrigerator appliance 100. Refrigerator appliance 100 includes a cabinet or housing 120 defining an upper fresh food chamber 122 and a lower freezer chamber 124 arranged below the fresh food chamber 122. As such, refrigerator appliance 100 is generally referred to as a bottom-mount refrigerator appliance. In the exemplary embodiment, housing 120 also defines a mechanical compartment (not shown) for receipt of a sealed cooling system. Using the teachings disclosed herein, one of skill in the art will understand that the present invention may be used with other types of refrigerator appliances (e.g., side-by-sides or top-mounts). Consequently, the description set forth herein is for illustrative purposes only and is not intended to limit the invention to any particular style of refrigerator appliance or arrangement of chilled chambers.

Refrigerator doors 126, 128 are rotatably hinged to an edge of housing 120 for accessing fresh food compartment 122. A freezer door 130 is arranged below refrigerator doors 126, 128 for accessing freezer chamber 124. In the exemplary embodiment, freezer door 130 is coupled to a freezer drawer (not shown) slidably mounted within freezer chamber 124.

Refrigerator appliance 100 includes a dispensing assembly 110 for dispensing liquid water and ice. Dispensing assembly 110 includes a dispenser 114 positioned on an exterior portion of refrigerator appliance 100. Dispenser 114 includes a discharging outlet 134 for accessing ice and liquid water. Dispensing assembly 110 further includes a sensor 112 positioned on discharging outlet 134. As will be described in more detail below, sensor 112 may be configured to detect a presence of a container positioned within dispensing assembly 110, and to detect the top lip of the container. A user interface panel 136 is provided for controlling the mode of operation. For example, user interface panel 136 includes a water dispensing button (not labeled) and an ice-dispensing button (not labeled) for selecting a desired mode of operation such as crushed, non-crushed ice, or liquid water, etc.

Discharging outlet 134 is an external part of dispenser 114, and is mounted in a dispensing recess or recessed portion 138 defined in an outside surface of refrigerator door 126. Recessed portion 138 is positioned at a predetermined elevation convenient for a user to access ice or liquid water and enabling the user to access ice or liquid water without the need to bend-over and without the need to access freezer chamber 124. In the exemplary embodiment, recessed portion 138 is positioned at a level that approximates the chest level of a user.

Operation of the refrigerator appliance 100 is regulated by a controller (not shown) that is operatively coupled to user interface panel 136 and/or sensor 112. Panel 136 provides selections for user manipulation of the operation of refrigerator appliance 100 such as e.g., selections between whole or crushed ice, chilled liquid water, and/or other options. In response to user manipulation of the user interface panel 136, the controller operates various components of the refrigerator appliance 100. The controller may be positioned in a variety of locations throughout refrigerator appliance 100. In the illustrated embodiment shown in FIG. 1, the controller is located within beneath the user interface panel 136 on door 126. In such an embodiment, input/output ("I/O") signals may be routed between controller and various operational components of refrigerator appliance 100. In one exemplary embodiment, the user interface panel 136 may represent a general purpose I/O ("GPIO") device or functional block. In another exemplary embodiment, the user interface 136 may include input components, such as one or more of a variety of electrical, mechanical or electromechanical input devices including rotary dials, push buttons, and touch pads. The user interface 136 may be in communication with the controller via one or more signal lines or shared communication busses.

Figure 2:
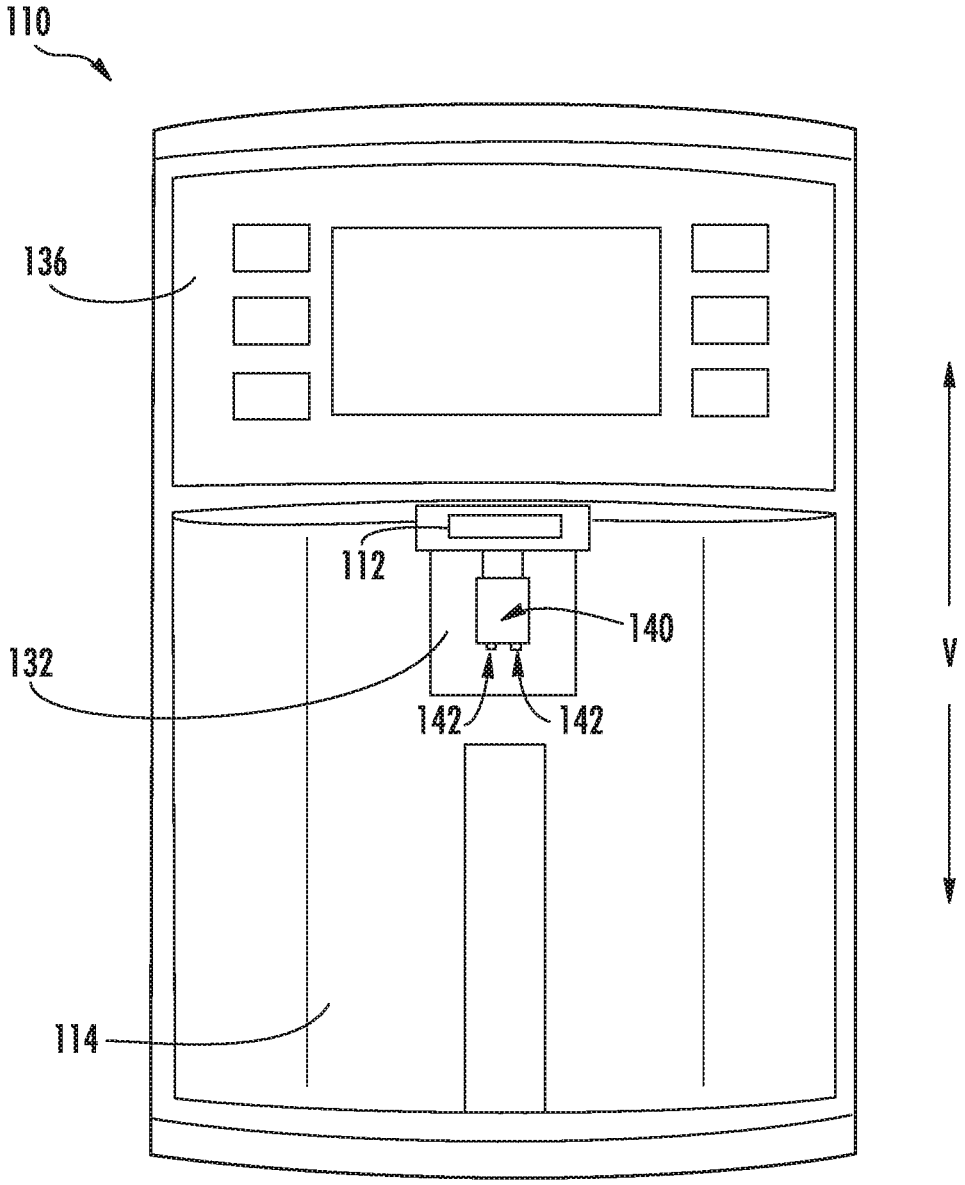
FIGS. 2 and 3 provide front, elevation views a dispensing assembly of the example refrigerator appliance of FIG. 1.

FIG. 2 provides a close-up front view of the dispenser 114 of dispensing assembly 110. An exemplary nozzle 140 is positioned adjacent to an activation member 132. Nozzle 140 includes a plurality of fluid outlets 142 through which liquid water may flow into a container placed into the recess 138 of dispensing assembly 110 by a user of appliance 100. Dispensing assembly 110 may further include a sensor, such as sensor 112. Sensor 112 may be positioned above nozzle 140 within dispenser 114. In particular, sensor 112 may be positioned within an upper portion of dispenser 114 such that one or more signals generated by sensor 112 are transmitted parallel to the liquid water stream. In this manner, sensor 112 may be positioned vertically above a container placed in dispenser 114.

In example embodiments, sensor 112 may be an ultrasonic transducer configured to periodically transmit and receive high frequency sound waves, and to convert the received sound waves into electrical data. In particular, sensor 112 may be configured to generate and transmit a sound wave, and to receive one or more echoed sound waves. Sensor 112 may further be configured to determine a time interval between transmitting the sound wave and receiving the one or more echoes. It will be appreciated that various other sensors and/or sensor configurations may be used, such as for instance, a sensor configuration including a separate and distinct transmitter and receiver.

Figure 3:
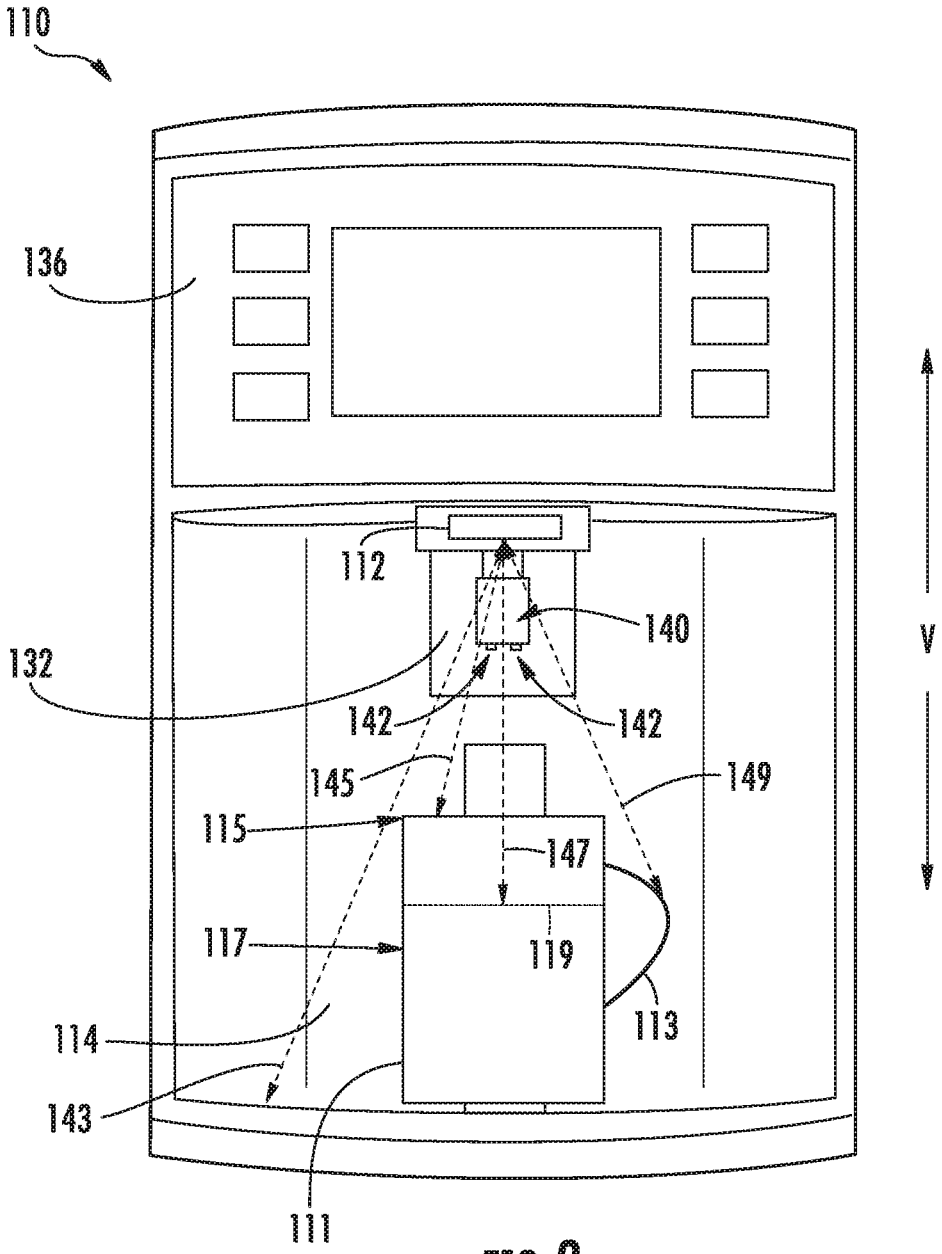

FIG. 3 provides a close-up front view of the dispenser 114 of dispensing assembly 110. In example embodiments, sensor 112 may be configured to detect a presence of a container 111 positioned proximate or within dispenser 114. For instance, sensor 112 may transmit one or more signals (e.g. sound waves), and receive one or more signals (e.g. reflected sound waves) indicative of container 111. In particular, the presence of a container may be detected at least in part by a comparison of a received signal with a baseline signal. The baseline signal may be a signal received by sensor 112 that is not reflected by a container. For instance, the baseline signal may be a signal transmitted by sensor 112 that is reflected, for instance, by a bottom surface of dispenser 114. Such signal may have an associated time interval corresponding to a particular known time interval (or range of time) for a signal transmitted by sensor 112 to return to sensor 112 in the absence of a container. When container 111 is positioned proximate dispenser 114, a different signal may be received corresponding at least in part to the signal reflected by container 111. Such signal may have a different corresponding time interval (or range of time), which may be indicative of the presence of container 111.

Dispenser 114 may be activated to initiate a flow of liquid water and/or ice into container 111 in response to an input to user interface panel 136, e.g., indicative of a request to dispense liquid water or ice. As another example, dispenser 114 may be activated to initiate a flow of liquid water and/or ice into container 111 in response to an input to user interface panel 136 and/or in response to detecting container 111 within dispenser 114. Components of refrigerator appliance 100 operable to dispense liquid water and/or ice are well known and not described in detail. As an example, the controller may open a water supply line valve to dispense liquid water. As another example, the controller open an ice chute door and activate an auger motor to dispense ice. The controller may immediately operate dispenser 114 to initiate the flow of liquid water and/or ice into container 111 in response to the input at user interface panel 136. Thus, there may be no delay or a negligible delay between the input at user interface panel 136 and dispensing of liquid water and/or ice into container 111. The presence of container 111 need not be detected before dispenser 114 will dispense liquid water or ice. For instance, when a user provides an input to user interface panel 136 indicative of a request to dispense liquid water, liquid water is dispensed in conjunction with the user input even if container 111 is not detected proximate dispenser 114 by sensor 112. After initiating the flow of liquid water and/or ice into container 111, sensor 112 may then be used to detect container 111, e.g., after a suitable delay, as described in greater detail below.

Sensor 112 may also be configured to detect a level of liquid water or ice 119 in container 111 relative to a top lip 115 of container 111. In example embodiments, sensor 112 may be configured to detect the level of the liquid water or ice 119 once the presence of a container has been detected. For instance, when a container is positioned proximate dispenser 114, various signals may be received by sensor 112 indicative of the various surfaces by which the signals are reflected. For instance, a signal may be received indicative of a bottom surface of dispenser 114 (e.g. signal 143). Such signal may correspond to the baseline signal described above. Further, a signal may be received indicative of top lip 115 of container 111 (e.g. signal 145), and a signal may be received indicative of the liquid water or ice level 119 within container 111 (e.g. signal 147). One or more signals may further be received indicative of the various geometries of container 111 (e.g. signal 149). For instance, container 111 includes a handle 113 extending horizontally from container 111. As shown, signal 149 is indicative of handle 113. As another example, if a container has a geometry wherein a middle portion 117 of the container has a larger radius than the top lip of the container, a signal may be received indicative of the middle portion 117, and a different signal may be received indicative of the top lip.

In example embodiments, top lip 115 may be identified based at least in part on the first received signal by sensor 112, such that the first received signal corresponds to the surface closest to the sensor (e.g. top lip 115). In this manner, the signal indicative of top lip 115 of container 111 may be distinguished from a signal indicative of, for instance, a middle portion 117 of container 111 (e.g. handle 113), or from a signal indicative of liquid water or ice in container 111. As described above, such signals may have an associated time intervals corresponding to the time it takes for the signal to travel from sensor 112, reflect off of a surface, and be received by sensor 112. The signal indicative of top lip 115 may have the shortest associated time interval.

Once top lip 115 is identified, a liquid water or ice level 119 within container 111 may also be identified. In particular, as dispenser 114 dispenses liquid water or ice, the liquid water or ice level 119 within container 111 will rise. As the level rises, the time interval corresponding to the signal that reflects off of the liquid water or ice will decrease. The signal indicative of the liquid water or ice level 119 may be identified due at least in part to the change in the level of the liquid water or ice. In this manner, the signal indicative of the liquid water level may be distinguished, for instance, from a signal indicative of a protruding middle portion 117 of container 111. For instance, a signal indicative of the level of liquid water in container 111 (e.g. signal 147), and a signal indicative of a middle portion 117 of container 111 (e.g. signal 149) may each have time intervals that are less than the time interval associated with signal 143 (e.g. the baseline signal) but greater than the time interval associated with signal 145. In example embodiments, the signal indicative of the level of liquid water may be distinguished from the signal indicative of middle portion 117 due to the changing characteristics of the signal indicative of the liquid water level.

Once the signals indicative of top lip 115 and the liquid water or ice level 119 have been identified, the liquid water or ice level 119 may be measured relative to top lip 115. For instance, as the liquid water or ice level 119 rises, the distance between the liquid water or ice level 119 and top lip 115 decreases. When the distance between top lip 115 and the liquid water or ice level 119 falls below a threshold distance, dispenser 114 may be configured to cease dispensing liquid water or ice. The threshold distance may be, for instance, between about three centimeters (3 cm) and fifteen centimeters (15 cm). In example embodiments, the distance between top lip 115 and the liquid water or ice level 119 may be determined based on the difference between the time intervals of the respective signals. Dispenser 114 may be configured to cease dispensing liquid water or ice when the difference between the time intervals corresponds to the threshold distance.

In example embodiments, a signal indicative of ice in container 111 may be distinguished from a signal indicative of liquid water in container 111. For instance, a container may first contain an amount of ice when a user requests for liquid water to be dispensed, such that the rising liquid water level may not initially be detected by sensor 112 due at least in part to the presence of the ice in container 111. In such embodiments, when ice may be detected but not liquid water, dispenser 114 may be configured to blindly dispense liquid water for an initial time period although the liquid water level cannot initially be detected. For instance, the initial time period may be a predetermined time period, or may be determined at least in part from the determined height of container 111.

In alternative embodiments, dispenser 114 may be configured to blindly dispense liquid water until a liquid water level within container 111 may be detected. For instance, the initial time period may correspond to the amount of time until a level of liquid water in container 111 is detected. In this manner, once sensor 112 is able to detect the liquid water level, dispenser 114 may be configured to dispense liquid water in accordance with example embodiments of the present disclosure. For instance, dispenser 114 may be configured to dispense liquid water until the distance between the liquid water level and top lip falls 115 below the threshold distance.

In such embodiments, liquid water may still be dispensed even if the distance between the ice level and top lip 115 of container 111 is less than the threshold distance. For instance, if a level of ice is detected a half inch (0.5") from the top lip of container 111, liquid water may still be dispensed. As the liquid water is dispensed into container 111, the overall level of contents in container 111 does not initially rise. In particular, the ice level and the liquid water level will converge as the ice settles and the liquid water level 119 rises. Accordingly, in such embodiments, liquid water may be dispensed by dispenser 114 until the distance between the combined liquid water and ice level 119 and top lip 115 is less than the threshold distance.

Figure 4:
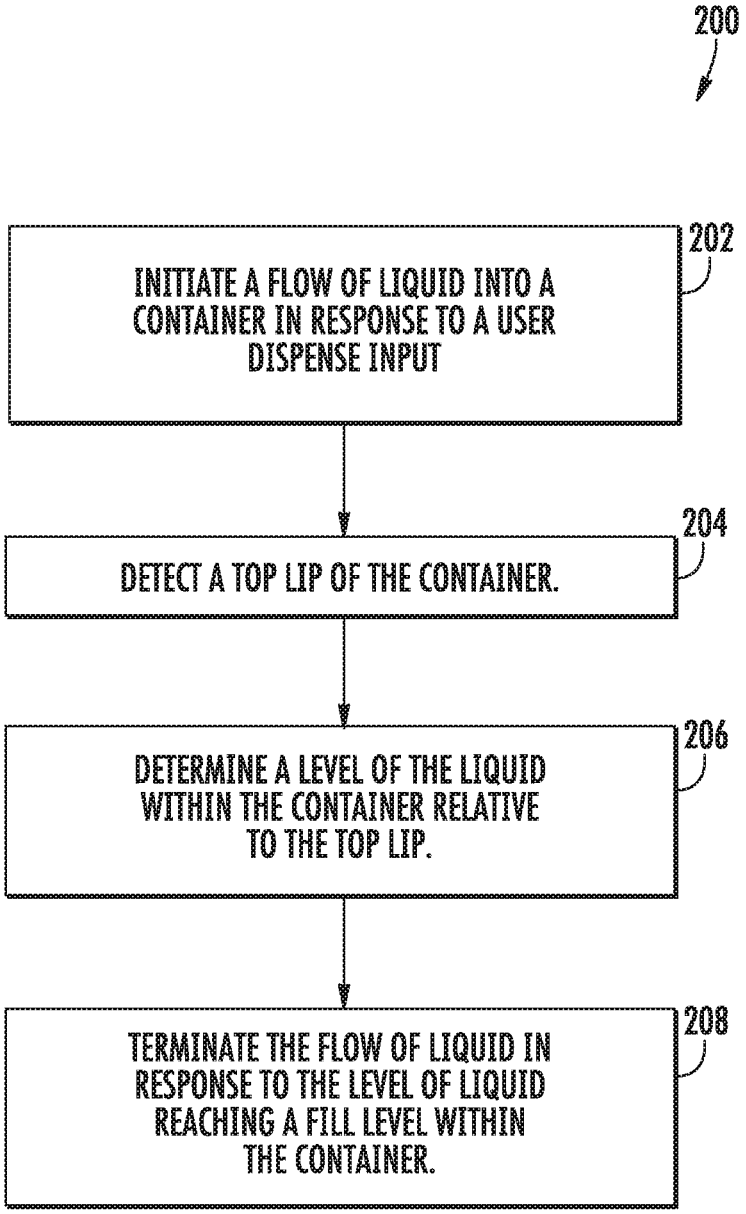
FIG. 4 illustrates a flow diagram of a method of dispensing liquid water or ice into a container according to example embodiments of the present disclosure.

FIG. 4 depicts a flow diagram of an example method (200) of dispensing liquid water according to example embodiments of the present disclosure. The method (200) may be implemented by one or more computing devices. As an example, method (200) may be used in or with refrigerator appliance 100 to dispense liquid water. The controller of refrigerator appliance 100 may be configured or programmed to implement method (200). In addition, FIG. 4 depicts steps performed in a particular order for purposes of illustration and discussion. Those of ordinary skill in the art, using the disclosures provided herein, will understand that the steps of any of the methods disclosed herein may be modified, adapted, expanded, omitted, and/or rearranged in various ways without deviating from the scope of the present disclosure.

At (202), method (200) may include receiving a user input indicative of a request for liquid water or ice to be dispensed. The user input may include an interaction with a user interface, a verbal command, or various other suitable user inputs. At (202), method (200) may include dispensing liquid water or ice. In example embodiments, liquid water or ice may be dispensed only responsive to the user input. Thus, e.g., a valve may be opened to dispense liquid water at (202) in response to the user input. As another example, an ice chute door may be opened and/or an auger motor may be activated to dispense ice at (202) in response to the user input. Dispensing of liquid water or ice is initiated at (202) without sensing or detecting a container within or proximate a dispenser. Thus, no sensor is required to sense or detect the container within or proximate a dispenser prior to dispensing liquid water or ice at the dispenser.

At (204), method (200) may include detecting the presence of the container proximate the dispenser. As described above, the dispenser may be configured to start dispensing liquid water or ice into the container at (202) simply in response to the user input. Method (200) may detect the container at (204) after initiating the flow of liquid water and/or ice into the container at (202) in response to the user input. Thus, liquid water and/or ice may be flowing into the container while the presence of the container proximate the dispenser is being detected at (204). Prior to detecting the presence of the container proximate the dispenser at (204), method (200) may operate under the assumption that the container is proximate the dispenser without confirming the presence of the container proximate the dispenser with a sensor until (204).

The container may be detected at (204) based at least in part on one or more signals received from the sensor. In example embodiments, the sensor may be an ultrasonic transducer configured to transmit one or more high frequency sound waves, and to receive one or more reflected high frequency sound waves. The sound waves received by the sensor may have associated time intervals corresponding to an amount of time between the transmission of the sound wave and reception of the corresponding reflected sound wave. The presence of the container may be detected at least in part on a comparison between the time interval of a received sound wave and a baseline time interval associated with a baseline signal. The baseline time interval may correspond to the amount of time between transmission of a sound wave by the sensor and reception of the sound wave when no container is present proximate the dispenser.

As liquid water or ice is being dispensed into the container, the level of liquid water or ice 119 will rise. In example embodiments, the dispenser may automatically cease dispensing liquid water or ice when the level of liquid water or ice 119 reaches a certain point. For instance, method (200) may include identifying a signal indicative of a top lip of the container. The top lip of the container may correspond to the highest point of the container. For instance, the top lip may be a rim of the container. The top lip of the container may be identified at least in part from the one or more signals received from the sensor. In particular, as described above, the top lip may correspond to signal having the shortest associated time interval.

The method (200) may also include determining the level of liquid water or ice within the container at (206). The level of liquid water or ice may be determined at least in part from the one or more signals received from the sensor. In example embodiments, liquid water or ice in the container may be identified based at least in part on a change in signals received from the sensor. In particular, as the liquid water or ice level rises (e.g. as liquid water or ice is being dispensed into the container), the time interval associated with the sound waves reflected by the liquid water or ice will shorten. The liquid water or ice level may be determined based on the changing time interval of such signals.

In example embodiments, the container may have a geometry wherein one or more lower portions of the container extend outwardly beyond the top lip. For instance, the container may have a handle, such as depicted in FIG. 3. In such embodiments, the sensor may receive sound waves reflected by the top lip and sound waves reflected from the lower portion. Signals received from the sensor indicative of the top lip of the container may be distinguished from signals indicative of the lower portion based at least in part on the time intervals associated with the signals. Further, signals indicative of the liquid water or ice level may be distinguished from signals indicative of the lower portion. In this manner, liquid water or ice in the container may not be confused with the lower portion of the container.

Method (200) may further include comparing the level of liquid water or ice within the container to a threshold distance at (206). The threshold distance may correspond to a desired amount of liquid water or ice in the container, such that the container does not overflow. In example embodiments, the threshold distance may be a distance measured relative to the bottom of the container (and/or the bottom surface of the dispensing assembly on which the container sits). For instance, the threshold distance may be a distance of six inches from the bottom of the container. In such embodiments, the threshold distance may be determined based at least in part on a determined height of the container. In further example embodiments, the threshold distance may be a distance measured relative to the top lip of the container. For instance, the threshold distance may be a distance of one inch from the top lip.

Method (200) may include ceasing dispensing liquid water or ice at (208) when the level of liquid water or ice in the container reaches the threshold distance. In this manner, once the liquid water or ice reaches an appropriate level, no more liquid water or ice will be dispensed into the container. In alternative embodiments, the dispenser may be configured to dispense liquid water for a period of time (e.g. a dispensing period). In such embodiments, the dispensing period may be a predetermined time period, or the dispensing period may be determined based at least in part on the determined height of the container and a determined width and/or radius of the container. For instance, if the height of the container is determined to be eight inches, and the radius is determined to be two inches, a dispensing period may be determined such that an appropriate amount of liquid water or ice is dispensed into the container during the dispensing period.

As indicated above, although the present disclosure generally contemplates a dispenser configured to dispense liquid water or ice, the dispenser may be further configured to dispense various other suitable forms of liquid and/or ice. Such other forms of liquid and/or ice may be dispensed according to example embodiments of the present disclosure. Thus, it will be understood that while described above in the context of a refrigerator appliance, the present subject matter may be used in or with any suitable dispenser in alternative exemplary embodiments. For example, the present subject matter may be used to operate a water cooler, a soda fountain, etc. As another example, the dispenser may be configured to dispense solid foods, such as candy, nuts, cereal, etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining a chilled chamber;

a door mounted to the cabinet, the door configured for permitting selective access to the chilled chamber of the cabinet;

a user input panel;

a dispenser defining a dispensing recess, the dispenser comprising a nozzle for dispensing liquid water or ice, the nozzle positioned at the dispensing recess;

a sensor disposed at the dispensing recess, the sensor configured to receive one or more signals indicative of a presence of a container proximate the dispensing recess and a level of contents in the container; and one or more control devices in operative communication with the user input panel, the dispenser and the sensor, the one or more control devices configured to:

operate the dispenser to initiate a flow of liquid water or ice into the dispensing recess through the nozzle in response to a user input at the user input panel;

receive one or more signals from the sensor after operating the dispenser to initiate the flow of liquid water or ice into the dispensing recess; and only after operating the dispenser to initiate the flow of liquid water or ice into the dispensing recess, detect the presence of the container within the dispensing recess based at least in part on the one or more signals from the sensor.

2. The refrigerator appliance of claim 1, wherein the one or more control devices are further configured such that the flow of liquid water or ice into the dispensing recess flows into the dispensing recess for no less than one second and no more than five seconds prior to detecting the presence of the container in the dispensing recess.

3. The refrigerator appliance of claim 1, wherein the one or more control devices are further configured to operate the dispenser to initiate the flow of liquid water or ice into the dispensing recess immediately after the user input at the user input panel.

4. The refrigerator appliance of claim 1, wherein the one or more control devices are further configured to: (1) deactivate the dispenser to terminate the flow of liquid water or ice into the dispensing recess when the level of contents in the container rises to a threshold level within the container; or (2) deactivate the dispenser to terminate the flow of liquid water or ice into the dispensing recess when a maximum dispense time elapses.

5. The refrigerator appliance of claim 1, wherein the sensor is an ultrasonic transducer operable to periodically transmit one or more sound waves and to receive one or more reflected sound waves.

6. The refrigerator appliance of claim 5, wherein the one or more reflected sound waves are indicative of at least one surface of the container.

7. The refrigerator appliance of claim 1, wherein the sensor is configured to detect one or more surfaces of the container, and wherein the one or more control devices are configured to distinguish a signal indicative of a top lip of the container from a signal indicative of a lower portion of the container.

8. The refrigerator appliance of claim 7, wherein the one or more control devices are further configured to distinguish the signal indicative of the level of contents in the container from the signal indicative of the lower portion of the container and from the signal indicative of the top lip of the container.

9. The refrigerator appliance of claim 1, wherein the one or more control devices are further configured to determine a height of the container based at least in part on the one or more signals from the sensor.

10. The refrigerator appliance of claim 1, wherein the sensor is positioned at the dispensing recess such that one or more sound waves transmitted by the sensor are transmitted parallel to the flow of liquid water or ice into the dispensing recess.

11. The refrigerator appliance of claim 1, wherein the user input panel and the dispenser are positioned on the door.

12. A method for operating a refrigerator appliance, comprising:

in response to a user input at a user input panel of the refrigerator appliance, operating a dispenser of the refrigerator appliance to initiate a flow of liquid water or ice into a container positioned within a dispensing recess of the dispenser;

receiving one or more signals from a sensor positioned at the dispensing recess after operating the dispenser to initiate the flow of liquid water or ice into the dispensing recess; and only after operating the dispenser to initiate the flow of liquid water or ice into the dispensing recess, detecting a presence of the container in the dispensing recess based at least in part on the one or more signals from the sensor.

13. The method of claim 12, wherein the flow of liquid water or ice into the dispensing recess flows into the container for no less than one second and no more than five seconds prior to detecting the presence of the container in the dispensing recess.

14. The method of claim 12, further comprising: (1) deactivating the dispenser to terminate the flow of liquid water or ice into the dispensing recess when a level of the liquid water or ice within the container in the dispensing recess rises to a threshold level within the container; or (2) deactivating the dispenser to terminate the flow of liquid water or ice into the dispensing recess when a maximum dispense time elapses.

15. The method of claim 12, wherein the sensor is configured to detect one or more surfaces of the container, the method further comprising distinguishing a signal indicative of a top lip of the container from a signal indicative of a lower portion of the container.

16. The method of claim 15, further comprising detecting a level of the liquid water or ice within the container based by distinguishing a signal indicative of the level of the liquid water or ice within the container from the signal indicative of the lower portion of the container and from the signal indicative of the top lip of the container.

17. The method of claim 12, further comprising determining a height of the container based at least in part on the one or more signals from the sensor.

* * * * *